US007743708B1

(12) United States Patent
Lawrence

(10) Patent No.: US 7,743,708 B1
(45) Date of Patent: Jun. 29, 2010

(54) NON LETHAL SPREAD PROJECTILE

(76) Inventor: James R. Lawrence, 172 Eight Oaks Dr., Bastrop, TX (US) 78602

( * ) Notice: Subject to any disclaimer, the term of this patent is extended or adjusted under 35 U.S.C. 154(b) by 303 days.

(21) Appl. No.: 12/150,739

(22) Filed: Apr. 30, 2008

(51) Int. Cl.
*F42B 8/00* (2006.01)

(52) U.S. Cl. ..... 102/502; 102/513

(58) Field of Classification Search ..... 102/502, 102/367, 370, 398, 444, 498, 501, 513, 520, 102/529, 293
See application file for complete search history.

(56) References Cited

U.S. PATENT DOCUMENTS

| | | | | | |
|---|---|---|---|---|---|
| 1,285,287 | A | * | 11/1918 | McDaniel | 102/529 |
| 3,037,454 | A | * | 6/1962 | Young | 118/506 |
| 3,782,286 | A | | 1/1974 | Jones et al. | 102/502 |
| 3,952,662 | A | | 4/1976 | Greenlees | 102/400 |
| 4,008,667 | A | * | 2/1977 | Look | 102/502 |
| 4,682,546 | A | * | 7/1987 | Chovich | 102/501 |
| 5,009,164 | A | * | 4/1991 | Grinberg | 102/502 |
| 5,221,809 | A | * | 6/1993 | Cuadros | 102/502 |
| 5,347,739 | A | * | 9/1994 | Stuart | 102/502 |
| 5,565,649 | A | * | 10/1996 | Tougeron et al. | 102/502 |
| 5,652,407 | A | | 7/1997 | Carbone | 102/438 |
| 6,041,712 | A | | 3/2000 | Lyon | 102/439 |
| 6,209,461 | B1 | | 4/2001 | Riffet et al. | 102/513 |
| 6,283,037 | B1 | | 9/2001 | Sclafani | 102/502 |
| 6,295,933 | B1 | | 10/2001 | Dubocage | 102/439 |
| 6,393,992 | B1 | | 5/2002 | Vasel et al. | 102/502 |
| 6,543,365 | B1 | | 4/2003 | Vasel et al. | 102/502 |
| 6,546,874 | B2 | | 4/2003 | Vasel et al. | 102/444 |
| 6,736,070 | B2 | * | 5/2004 | Baltos | 102/512 |
| 6,782,828 | B2 | | 8/2004 | Widener | 102/502 |
| 7,013,810 | B1 | * | 3/2006 | Brydges-Price | 102/502 |
| 7,089,863 | B1 | | 8/2006 | Dindl | 102/444 |
| 2004/0089186 | A1 | * | 5/2004 | Brygdes-Price | 102/502 |
| 2008/0223246 | A1 | * | 9/2008 | Dindl et al. | 102/502 |

* cited by examiner

*Primary Examiner*—Michael Carone
*Assistant Examiner*—Jonathan C Weber
(74) *Attorney, Agent, or Firm*—Derek R. Van Gilder

(57) ABSTRACT

A non-lethal spread projectile has a center pin (1) as a guide on which a weight plunger (5) is caused by impact stop of gun-fired flight momentum to slide from an aft end (3) to a front end (2) of a spread projectile (4) for spreading fill material (9) in a fill bag (10) ahead of the weight plunger over a broad surface of an impacted target (25) for preventing damaging penetration of the spread projectile into the impacted target and to mark the impacted object predeterminedly.

20 Claims, 3 Drawing Sheets

FIG. 8
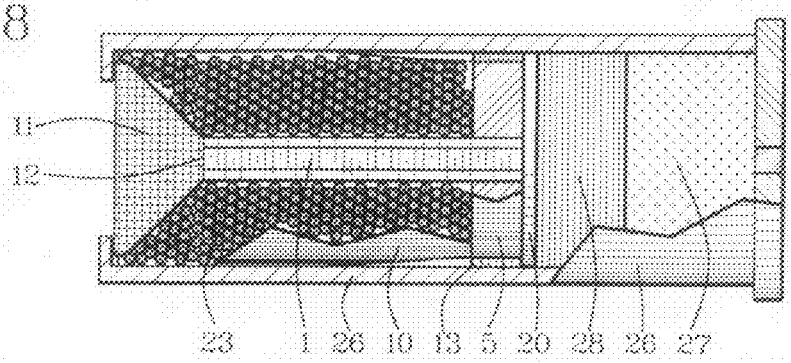
FIG. 9
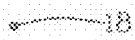
FIG. 11
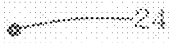
FIG. 13
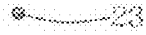
FIG.10
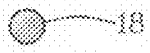
FIG. 12
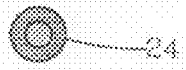
FIG. 14
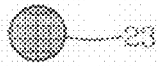
FIG. 15
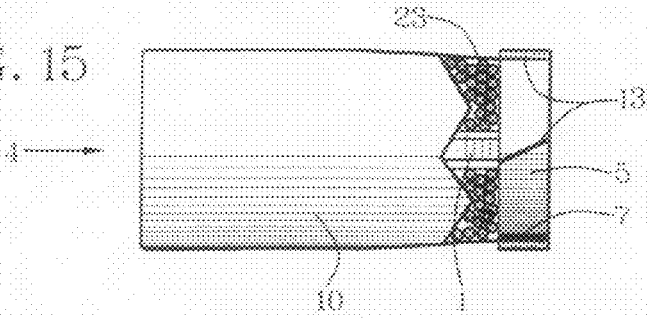
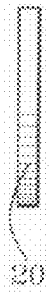
FIG. 16
FIG. 17
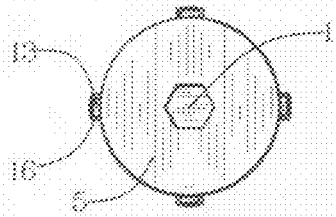
FIG. 18
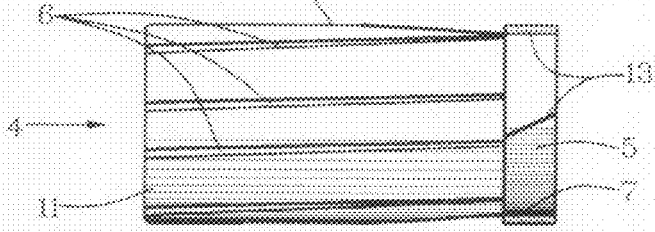

NON LETHAL SPREAD PROJECTILE

BACKGROUND OF THE INVENTION

1. Field of the Invention

This invention relates to weapon projectiles for non-lethal incapacitation of live targets.

2. Relation to Prior Art

Non-lethal projectiles, also known as less-than-lethal projectiles, for achieving non-lethal incapacitation of people or animals by police, military personnel and other public authorities with shotguns or rifles are well known. None have proved to be sufficiently capable of incapacitating people or animals with adequate assurance of preventing unintentional injury or death in a manner taught by this invention.

Related but different prior art includes the following patent documents:

| | | |
|---|---|---|
| U.S. Pat. No. 3,782,286 | Jones et al | 1974 |
| U.S. Pat. No. 3,952,662 | Greenlees | 1976 |
| U.S. Pat. No. 5,652,407 | Carbone | 1997 |
| U.S. Pat. No. 6,041,712 | Lyon | 2000 |
| U.S. Pat. No. 6,302,028 B1 | Guilott-Ulmann et al | 2001 |
| U.S. Pat. No. 6,295,933 B1 | Dubocage et al | 2001 |
| U.S. Pat. No. 6,283,037 B1 | Sclafani | 2001 |
| U.S. Pat. No. 6,209,461 B1 | Riffet et al | 2001 |
| U.S. Pat. No. 6,393,992 B1 | Vasel et al | 2002 |
| U.S. Pat. No. 6,546,874 B2 | Vasel et al | 2003 |
| U.S. Pat. No. 6,543,365 B1 | Vasel et al | 2003 |
| U.S. Pat. No. 6,782,828 B2 | Widener | 2004 |
| U.S. Pat. No. 7,089,863 | Dindl | 2006 |

SUMMARY OF THE INVENTION

Objects of patentable novelty and utility taught by this invention are to provide a non-lethal spread projectile which:

provides stabilization spin when shot from either a smooth bore or a rifled bore;

spreads fill material over a sufficiently wide area of an impacted target to prevent unwanted penetration;

can be manufactured reliably; and is cost effective.

This invention accomplishes these and other objectives with a non-lethal spread projectile having a center pin on which a weight plunger is caused by impact stop of gun-fired flight momentum to slide from an aft end to a front section of a spread projectile and to spread fill material ahead of the weight plunger over a broad surface of an impacted target for preventing damaging penetration of the spread projectile into the impacted target. In-flight stabilization spin of the spread projectile is achieved by bevel fins on an aft portion of the spread projectile. A preferably grooved head of the spread projectile is attached to a front of the center pin. A fill bag is positioned partly in grooves of the grooved head and encloses a length of the spread projectile from the grooved head to the weight plunger. On impact, the fill bag unfolds from the grooves of the grooved head and spreads to position the fill material over a wide area of the impacted target. A buffer shield can be employed to shield at least a rear portion of the spread projectile for assembly and for absorbing impact of gun-powder explosion. The fill material can be clay, shot, grease-based material or other substance selected to match impact-spread objectives for the spread projectile.

BRIEF DESCRIPTION OF DRAWINGS

This invention is described by appended claims in relation to description of a preferred embodiment with reference to the following drawings which are explained briefly as follows:

FIG. 8 is a partially cutaway side view of a spread projectile having a rubber-pellet fill material and a protective shield without a protective sleeve;

FIG. 9 is a side view of a single small shot pellet;

FIG. 10 is a side view of a single large shot pellet;

FIG. 11 is a side view of a single small rubber-covered shot pellet;

FIG. 12 is a side view of a single large rubber-covered shot pellet;

FIG. 13 is a side view of a single small rubber shot pellet;

FIG. 14 is a side view of a single large rubber shot pellet;

FIG. 15 is a partially cutaway side view of the spread projectile of the FIG. 8 illustration in flight after separation from the buffer shield without the buffer sleeve;

FIG. 16 is a side view of the buffer shield without the buffer sleeve;

FIG. 17 is an aft side view of a weight plunger having flight stabilization fins with bag fins superimposed on them; and FIG. 18 is a side view of the non-lethal-spread projectile showing grooves extended rearwardly in a fill bag.

DESCRIPTION OF PREFERRED EMBODIMENT

Figure 1:
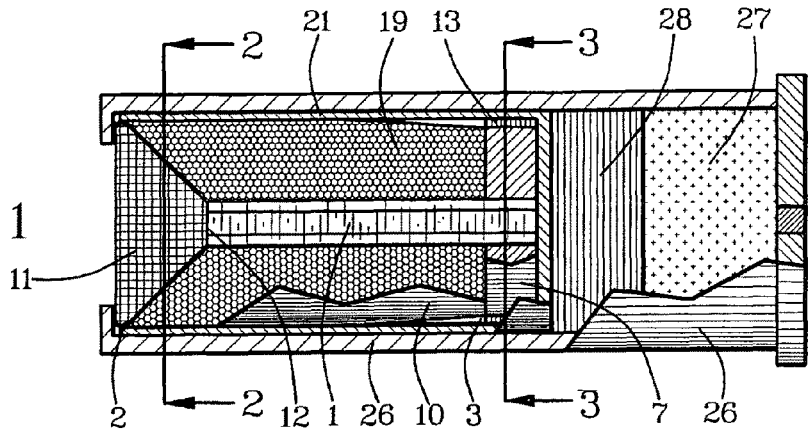
FIG. 1 is a partially cutaway side view of a spread projectile having a viscose fill material.
Figure 2:
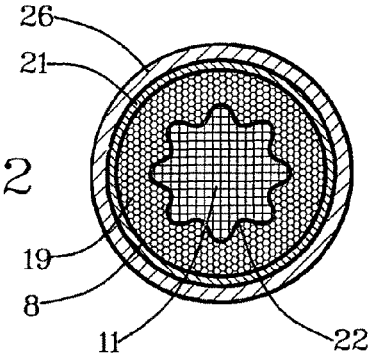
FIG. 2 is a cross-section view of the FIG. 1 illustration from section line 2-2 of FIG. 1.

Referring to FIGS. 1-4 and 8, positioned in a shell (26) with powder (27) and wadding (28) for being fired from either a smooth bore or a rifled bore of a gun, a non-lethal-spread projectile (4) has a center pin (1) extended from proximate a front end (2) to proximate an aft end (3) of the spread projectile (4). A weight plunger (5) has a central orifice with plunger walls (15) slidable on an outside periphery of the center pin (1). A plunger circumferential perimeter (7) is proximate a stabilization-fin-height distance inward circumferentially from a projectile circumferential perimeter (8) of the spread projectile (4).

Figure 3:
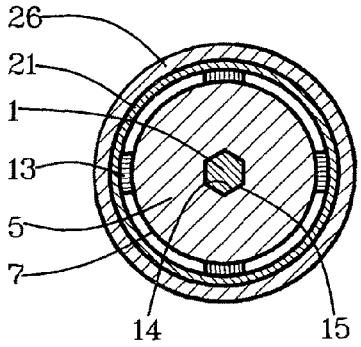
FIG. 3 is a cross-section view of the FIG. 1 illustration from section line 3-3 of FIG. 1.
Figure 4:
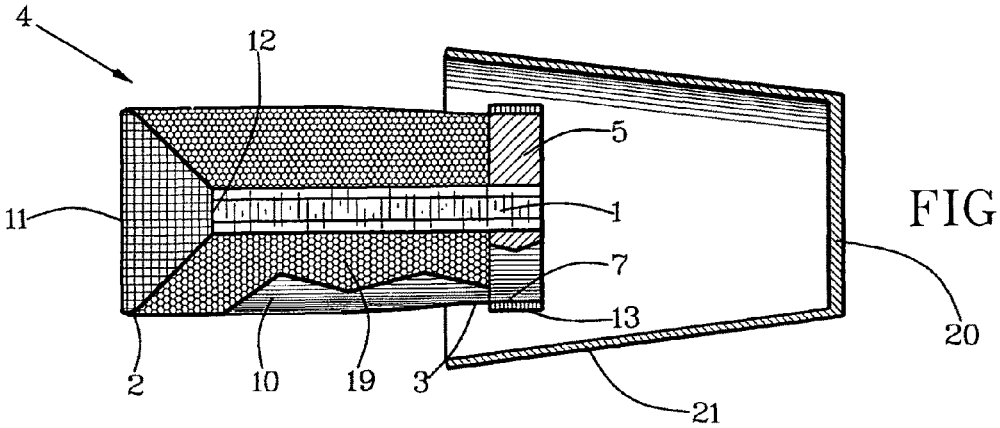
FIG. 4 is a partially cutaway side view of the spread projectile in early flight with a buffer shield being separated and left behind after discharge from a gun barrel.
Figure 5:
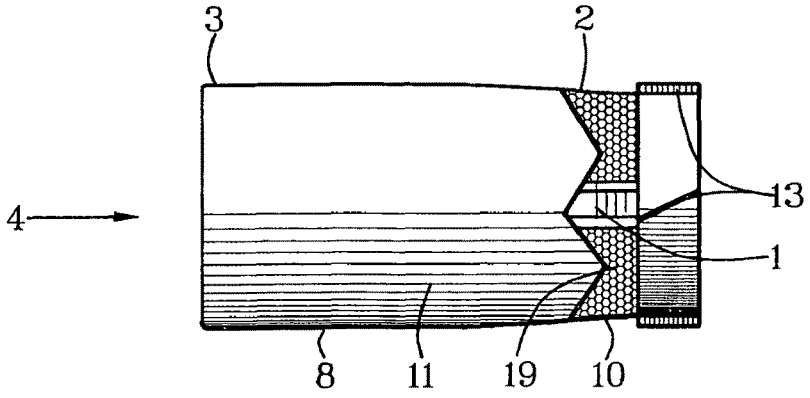
FIG. 5 is a partially cutaway side view of the spread projectile of the FIG. 1 illustration in flight after separation from the buffer shield.
Figure 6:
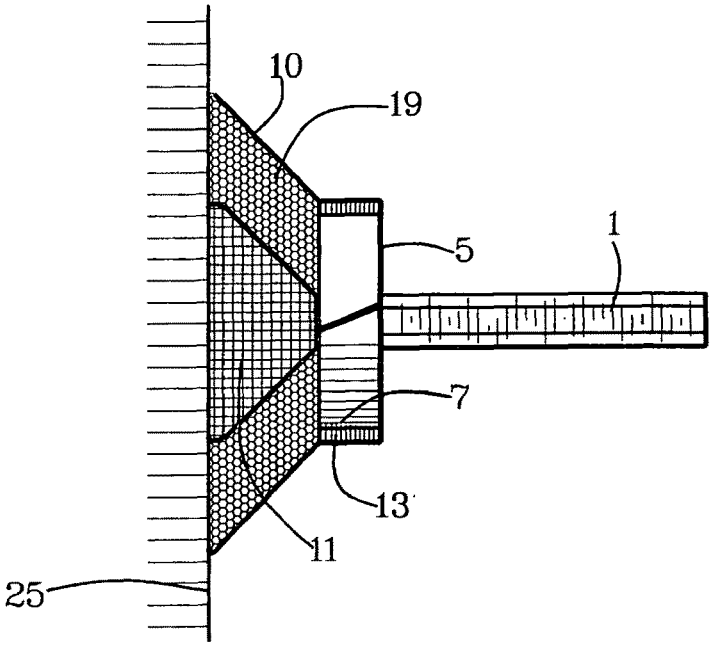
FIG. 6 is a partially cutaway side view of the spread projectile in spread mode on an impacted object.
Figure 7:
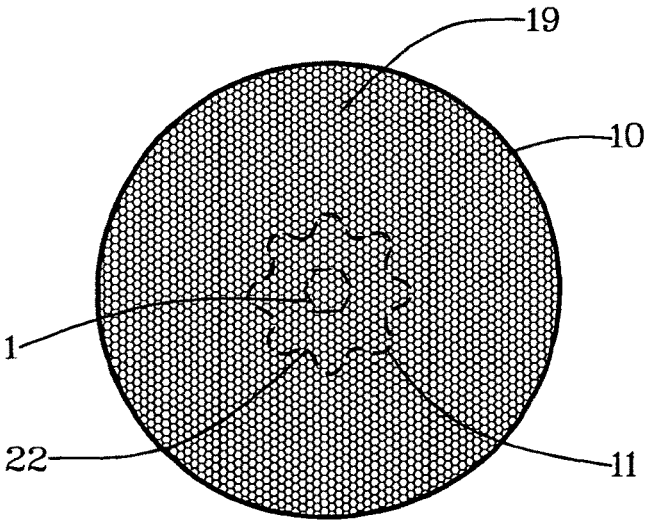
FIG. 7 is a front view of the spread projectile in spread mode.

The center pin (1) is keyed designedly to the weight plunger (5) for preventing rotation of the weight plunger (5) on the center pin (1). As shown in FIG. 3, keyed design of the center pin (1) can include a channeled keyway or a polygonal structure such as a square or a hexagonal cross section as shown for having at least one pin wall (14) in sliding contact with at least one plunger wall (15).

The weight plunger (5) has a mass predetermined for causing the weight plunger (5) to travel forward on the center pin (1) from momentum force of projectile travel when the projectile travel is stopped from impact of the spread projectile (4) with an impacted object (25).

Predetermined fill material, shown as viscose material (19) and represented by honeycomb hatching in FIGS. 1, 2, 4, 5, 6 and 7, is positioned in a fill bag (10) intermediate a grooved head (11) and proximate the weight plunger (5).

The center pin (1) has a pin front (12) attached to the fill bag (10), causing the fill bag (10) to rotate with the center pin (1) and the weight plunger (5).

At least one flight-stabilization fin (13), preferably four or more as shown, are positioned on the spread projectile (4), preferably on the weight plunger (5). The flight-stabilization fin(s) (13) cause rotation for flight stabilization, regardless of whether the spread projectile (4) is fired from a smooth bore or a rifled bore of a weapon.

The fill bag (10) has a volumetric capacity for containing a predetermined volume of the fill material and for positioning of the fill material over a predetermined area of the impacted object (25).

The flight-stabilization fin (13) can include a bag fin (16) on an aft end of the fill bag (10). The bag fin (16) can be superimposed on the flight-stabilization fin (13) as shown in FIG. 17.

The fill material can include a plurality of shot pellets (18) which can be predeterminedly small as shown in FIG. 9 or predeterminedly large as shown in FIG. 10.

The fill material can include a viscous fluid (19) for spreading on an impacted object (25) predeterminedly. The viscous fluid (19) can include clay which is not shown separately.

The viscous fluid (19) can include a coloring fluid, which is not shown separately, for coloring the impacted object.

A buffer shield (20) can be positioned on an aft side of the weight plunger (5) for absorbing pressure of powder explosion. The buffer shield (20) is structured and positioned to direct explosion pressure against the center pin (1) and the weight plunger (5) simultaneously for preventing the weight plunger (5) from being pushed ahead with explosion pressure prior to impact of the spread projectile (4) with the impacted object (25).

The buffer shield (20) can include a cover sleeve (21) extended predeterminedly forward from the buffer shield (20) for assembly and initial-flight containment. The cover sleeve (21) is optional to use of the fill bag (10), as shown in FIG. 8, for assembly containment of the fill material.

The grooved head (11) can have head grooves (22) for containing the fill bag (10) in a folded mode prior to impact expansion and spreading.

As shown in FIG. 18, the fill bag (10) can have spin grooves (6) positioned rearwardly from the grooved head (11) and slanted circumferentially for assisting projectile rotation for sliding against a rifle bore and from encountering air in flight after exit from the rifle bore.

A method can have the following steps for spreading a spread projectile (4) on an impacted object (25) with impact momentum:

positioning a weight plunger (5) on an aft end of the spread projectile (4);

providing a flight-stabilization fin (13) proximate an aft end of the spread projectile (4);

providing fill material in a fill bag (10) intermediate the weight plunger (5) and a head of the spread projectile (4);

positioning the weight plunger (5) in slidable contact with a linear guide member intermediate a front end (2) of the spread projectile (4) and an aft end (3) of the spread projectile (4); and causing the weight plunger (5) to have a mass sufficient for gun-fired flight momentum of the weight plunger (5) to push the weight plunger (5) against the fill bag (10) for causing the fill material in the fill bag (10) to be spread over an impacted object (25) intermediate the impacted object (25) and the weight plunger (5) predeterminedly.

The method can include the linear guide member being a center pin 1; and the weight plunger (5) having a central orifice with a plunger wall (15) on an inside periphery in slidable contact with an outside periphery of a pin wall (14) of the center pin (1).

The method can include the fill material being clay which can be predeterminedly viscous and colored.

The method can include the fill material being a grease-based material.

The method can include the grease-based material being predeterminedly viscous.

The method can include the fill bag (10) being predeterminedly porous; and the fill material being colored predeterminedly.

The method can include the fill material being shot pellets (18) as shown in FIGS. 9-10.

The method can include the fill material being rubberlike pellets (23) as shown in FIGS. 8 and 13-15.

The method can include the shot pellets (18) being lead pellets.

The method can include the fill material being rubber-covered metal pellets (24) as shown in FIGS. 11-12.

A new and useful non-lethal spread projectile having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A non-lethal-spread projectile comprising:

a center pin (1) extended from proximate a front end (2) to proximate an aft end (3) of a spread projectile (4);

a weight plunger (5) having a central orifice with plunger walls (15) slidable on an outside periphery of the center pin (1) and having a plunger circumferential perimeter (7) proximate a stabilization-fin-height distance inward from a projectile circumferential perimeter (8) of the spread projectile (4);

the weight plunger (5) having a mass predetermined for causing the weight plunger (5) to travel forward on the center pin (1) from momentum force of projectile travel when the projectile travel is stopped from impact of the spread projectile (4) with an impacted object (25);

predetermined fill material in a fill bag (10) intermediate a grooved head (11) and proximate the weight plunger (5);

the center pin (1) having a pin front (12) attached to the fill bag (10);

at least one flight-stabilization fin (13) on the spread projectile (4); and the fill bag (10) having a volumetric capacity for containing a predetermined volume of the fill material and for positioning of the fill material over a predetermined area of an impacted object (25).

2. The apparatus of claim 1 in which:

the center pin (1) is keyed with at least one pin wall (14) on an outside periphery of the center pin (1) intermediate proximate the front end (2) and the aft end (3) of the spread projectile (4);

the central orifice of the weight plunger (5) is keyed with at least one plunger wall (15) in slidable contact with the pin wall (14) for preventing rotation of the weight plunger (5) on the center pin (1); and the flight-stabilization fin (13) is affixed to the weight plunger (5) for transmitting rotational force of the flight-stabilization fin (13) to the center pin (1) and to the fill bag (10) for stabilization rotation of the spread projectile (4).

3. The apparatus of claim 1 in which:

the flight-stabilization fin (13) includes a bag fin (16) on an aft end of the fill bag (10).

4. The apparatus of claim 3 in which:

the bag fin (16) is superimposed on the flight-stabilization fin (13).

5. The apparatus of claim 1 in which:

the fill material includes a plurality of shot pellets (18).

6. The apparatus of claim 1 in which:

the fill material includes a viscous fluid (19) for spreading on an impacted object predeterminedly.

7. The apparatus of claim 6 in which:

the viscous fluid (19) includes clay.

8. The apparatus of claim 6 in which:

the viscous fluid (19) includes a coloring fluid for coloring the impacted object (25).

9. The apparatus of claim 1 in which:

a buffer shield (20) is positioned on an aft side of the weight plunger (5) for absorbing pressure of powder explosion.

10. The apparatus of claim 9 in which:

the buffer shield (20) includes a cover sleeve (21) extended predeterminedly forward from the buffer shield (20) for assembly and initial-flight containment.

11. The apparatus of claim 1 in which:

the grooved head (11) has head grooves (22) for containing the fill bag (10) in a folded mode prior to impact expansion and spreading.

12. A method comprising the following steps for spreading a spread projectile (4) on an object with impact momentum:

providing a weight plunger (5) on an aft end (3) of the spread projectile (4);

positioning a flight-stabilization fin (13) on the aft end (3) of the spread projectile (4);

providing fill material in a fill bag (10) intermediate the weight plunger (5) and a head of the spread projectile (4);

positioning the weight plunger (5) in slidable contact with a linear guide member intermediate the aft end (2) of the spread projectile (4) and a front section (3) of the spread projectile (4); and causing the weight plunger (5) to have a mass predetermined for gun-fired flight momentum of the weight plunger (5) to push the weight plunger (5) against the fill bag (10) for causing the fill material in the fill bag (10) to spread over an impacted object (25) intermediate the impacted object (25) and the weight plunger (5) predeterminedly.

13. The method of claim 12 in which:

the linear guide member is a center pin (1); and the weight plunger (5) has a central orifice with an inside periphery in slidable contact with an outside periphery of the center pin (1).

14. The method of claim 12 in which:

the fill material includes clay which can be predeterminedly viscous and colored.

15. The method of claim 12 in which:

the fill material includes a grease-based material; and the grease-based material is predeterminedly viscous.

16. The method of claim 15 in which:

the fill bag (10) is predeterminedly porous; and the grease-based material is colored predeterminedly.

17. The method of claim 12 in which:

the fill material includes shot pellets (18).

18. The method of claim 12 in which:

the fill material includes rubberlike pellets (23).

19. The method of claim 12 in which:

the fill material includes lead pellets.

20. The method of claim 12 in which:

the fill material includes rubber-covered metal pellets (24).

* * * * *